United States Patent [19]

Chisolm

[11] Patent Number: 4,606,709

[45] Date of Patent: Aug. 19, 1986

[54] LIQUID PUMP WITH SEQUENTIAL OPERATING FLUID PISTONS

[75] Inventor: James P. Chisolm, Sand Springs, Okla.

[73] Assignee: Special Projects Mfg. Co., Fort Worth, Tex.

[21] Appl. No.: 769,314

[22] Filed: Aug. 26, 1985

Related U.S. Application Data

[63] Continuation-in-part of Ser. No. 632,685, Jul. 20, 1984, abandoned, which is a continuation of Ser. No. 408,759, Aug. 17, 1982, abandoned.

[51] Int. Cl.[4] ..... F04B 9/10

[52] U.S. Cl. ..... 417/347; 417/397; 91/189 R; 92/85 B

[58] Field of Search ..... 417/342, 347, 533, 536, 417/397, 539, 339; 60/537, 567, 576, 581; 91/535, 189 R, 512; 92/85 B

[56] References Cited

U.S. PATENT DOCUMENTS 1,890,428 12/1932 Ferris et al. ..... 60/372
2,665,555 1/1954 Martinsson ..... 91/535
2,991,003 7/1961 Petersen ..... 417/397
4,269,569 5/1981 Hoover ..... 417/347

FOREIGN PATENT DOCUMENTS 1191069 4/1965 Fed. Rep. of Germany ..... 417/397

*Primary Examiner*—Leonard E. Smith
*Attorney, Agent, or Firm*—James E. Bradley

[57] ABSTRACT

An intensifier pump has a primary fluid cylinder including a primary piston and which has shaft portions received within a separate coaxial fluid chamber. A secondary fluid cylinder having a secondary piston has shaft portions reciprocally received within a separate coaxial fluid chamber. The secondary piston is of a smaller relative diameter than the primary piston. The sizing of the hydraulic pistons in the operating fluid cylinders is used to sequence the pistons in the cylinders with the largest diameter piston being stroked first followed by the second largest diameter cylinder being stroked next, followed in turn by any additional fluid cylinders in the order of the piston diameter size. When the smallest diameter cylinder has been stroked, a pressure switch signals a reverse flow pump to change the direction of circulation of the operating fluid to cycle the pistons.

6 Claims, 4 Drawing Figures

LIQUID PUMP WITH SEQUENTIAL OPERATING FLUID PISTONS

CROSS-REFERENCE TO RELATED APPLICATIONS

This application is a continuation-in-part of application Ser. No. 632,685 filed July 20, 1984, now abandoned, which was a continuation of application Ser. No. 408,759, filed Aug. 17, 1982, now abandoned.

BACKGROUND OF THE INVENTION

1. Field of the Invention

The present invention relates to multiplex, intensifier, piston-type pumps which are hydraulically driven and which are especially suitable for pumping mud and other well fluids in the drilling, completion, and workover of oil and gas wells.

2. Description of the Prior Art

Hydraulically driven pumps are known in the art. The plunger in each pump unit is driven by a fluid. One undesirable characteristic of prior pump designs has been the pulsating discharge and suction of such pumps. Various schemes have been employed in an attempt to overcome this pulsating characteristic such as increasing the number of acting pistons or plungers and overlapping their strokes, or by providing a surge chamber in which the pump fluid is accumulated and discharged at stroke reversal. Controls for returning the hydraulic piston are complex. As a result of the above designed changes, the cost and complexity of the pumping units has increased considerably.

SUMMARY OF THE INVENTION

The intensifier pump of the invention has a primary fluid cylinder and a primary piston rod having a primary piston which is reciprocally received within the primary cylinder. The primary piston rod has shaft portions which extend in opposite directions from the primary piston, each of the shaft portions being reciprocally received within a separate fluid chamber.

Reversible operating means communicates with the primary fluid cylinder for supplying operating fluid to a high pressure side of the primary fluid cylinder and draining operating fluid from an opposite low pressure side of the primary fluid cylinder.

A secondary fluid cylinder has a secondary piston rod with a secondary piston which is reciprocally received within the secondary fluid cylinder. The secondary piston rod has shaft portions which extend in opposite directions from the secondary piston, each of the shaft portions being reciprocally received within a separate fluid chamber. The secondary piston is of smaller relative diameter than the primary piston. Conduit means communicate the high pressure side of the primary fluid cylinder with a high pressure side of the secondary fluid cylinder and communicate the low pressure side of the primary fluid cylinder with a low pressure side of the secondary fluid cylinder, whereby operating fluid from the reversible operating means contacts the primary piston and the secondary piston to move the pistons within the respective fluid cylinders.

Each of the separate fluid chambers has a fluid inlet and a fluid outlet for receiving and discharging working fluid from the chambers in response to the movement of the primary and secondary pistons in the primary and secondary fluid chambers.

The separate working fluid chambers fluid inlets and outlets communicate with a common source of working fluid. Valve means in the fluid chamber fluid inlets and fluid outlets control the flow of working fluid through the fluid chambers. The large diameter primary piston causes a pressure at the common outlets that is larger than the pressure caused by the secondary piston at its outlet. This prevents the secondary piston from moving until the primary piston completes its stroke. A detector means reverses the flow of hydraulic fluid only when the smallest diameter piston completes its stroke.

Fluid cushions are located near the ports of the operating fluid chambers to dampen movement of the piston as it nears the end of its stroke. The fluid cushion for the smallest piston provides a greater degree of dampening than the others to accommodate the time required for the reversible pump to reverse.

DETAILED DESCRIPTION OF THE INVENTION

Figure 1:
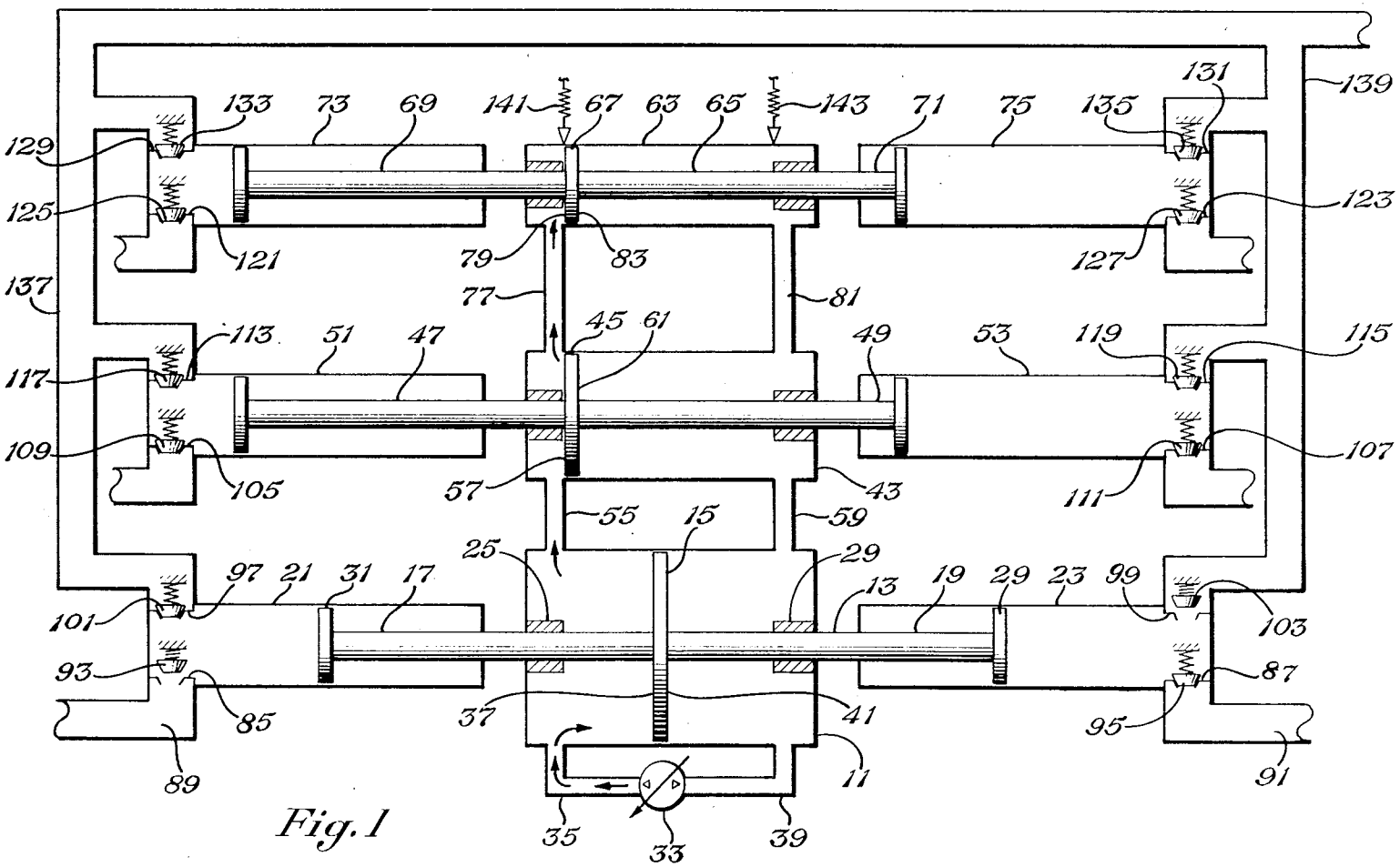
FIG. 1 is a schematic drawing of the operation of the intensifier pump of the invention showing the movement of the primary piston in the primary fluid cylinder.

Turning to FIG. 1, there is shown an intensifier pump which has a primary operating fluid cylinder 11. The primary fluid cylinder 11 has a primary piston rod 13 having a primary piston 15 which is reciprocally received within the primary fluid cylinder 11. Primary piston rod 13 also has shaft portions 17, 19 extending coaxially in opposite directions from primary piston 15, each of which is reciprocally received within a separate working fluid chamber 21, 23. Packing 25, 27 seals the primary piston rod 13 for reciprocal movement within primary fluid cylinder 11. Although shaft portions 17,19 are shown with piston ends 29, 31, it should be understood that the ends 29, 31 could as easily be cylindrical rods which are received within working fluid chambers 21, 23 for reciprocal movement. Separate working fluid chambers 21, 23 are preferably of a smaller diameter than primary operating fluid cylinder 11. The shaft ends 29, 31 are preferably of a lesser area or diameter than the pressure area of primary piston 15.

A reversible operating means such as a reversible flow variable displacement pump 33 communicates with a first port in cylinder 11 by means of a supply conduit 35 for supplying hydraulic operating fluid to a high pressure side 37 of the primary operating fluid cylinder 11. Reversible flow type pump 33 also communicates with a second port in cylinder 11 by means of a drain or return conduit 39, when in the position shown in FIG. 1, for draining fluid from an opposite low pressure side 41 of primary fluid cylinder 11. Pump 33 is a conventional pump that has means internally for varying volume and pressure to achieve a constant power output.

A secondary operating fluid cylinder 43 is provided having a secondary piston 45 which is reciprocally received within the secondary fluid cylinder 43 and having shaft portions 47, 49 extending in opposite directions from secondary piston 45, each of the shaft portions 47, 49 being reciprocally received within a separate working fluid chamber 51, 53 in identical fashion to shafts 17, 19 in fluid chambers 21, 23. The secondary piston is of smaller relative diameter than primary piston 15. The internal diameter of secondary operating fluid cylinder 43 is preferably less than the internal diameter of primary operating fluid cylinder 11 but is preferably greater than the internal diameter area of working fluid chambers 51, 53.

The primary piston 15 has a selected greater diameter than the secondary piston 45. A fluid conduit 55 communicates a port in the high pressure side 37 of primary fluid cylinder 11 with a high pressure side 57 of the secondary fluid cylinder 43. An identical fluid conduit 59 communicates a port in the low pressure side 41 of primary fluid cylinder 11 with a low pressure side 61 of secondary fluid cylinder 43.

Additional secondary fluid cylinders such as cylinders 63 can be provided adding a piston rod 65 including a piston 67 reciprocally received within the additional cylinder 63 in the fashion previously described. Piston 67 has shaft portions 69, 71 extending in opposite directions from additional piston 67, each of the shaft portions 69, 71 being reciprocally received within a separate fluid chamber 73, 75. Fluid chambers 21, 23, 51, 53, 73 and 75 are equal in diameter. Additional conduit means including additional conduit 77 communicates a port in the high pressure side 57 of the secondary fluid cylinder with a high pressure side 79 of additional fluid cylinder 63. An additional fluid conduit 81 communicates a port in the low pressure side 61 of secondary fluid cylinder 43 with a low pressure side 83 of additional fluid cylinder 63. The additional piston 67 is of smaller relative diameter than the secondary fluid cylinder piston 45.

As shown in FIG. 1, separate working fluid chambers 21, 23 have working fluid inlets 85, 87 for receiving working fluid, such as well mud or fracturing fluid, through working fluid supply conduits 89, 91, which can run from a common source. Valve means such as check valves 93, 94 in the fluid chamber fluid inlets 85, 87 control the flow of working fluid into the fluid chambers 21, 23.

In similar fashion, each of the chambers 21, 23 has a fluid outlet 97, 99 for controlling the discharge of working fluid from the chambers 21, 23 by means of check valves 101, 103. In the same way, the chambers 51, 53 are provided with working fluid inlets 105, 107 having check valves 109, 111 and fluid outlets 113, 115 having check valves 117, 119. Fluid chambers 73, 75 are provided with working fluid inlets 121, 123 having check valves 125, 127 and fluid outlets 129, 131 controlled by check valves 133, 135. Fluid inlets 85, 105, 121 of chambers 21, 51, 73 communicate with a common source of working fluid through an intake conduit 89. Fluid inlets 87, 107, 123 communicate with the same common source of working fluid through an intake conduit 91. Normally working fluid, such as fluid to be pumped down a well, will be supplied at a fairly low pressure to fluid inlets 87, 107, 123 and 82, 105, and 121, the supply pressure being insufficient to open any of the valves 95, 111, 127, 93, and 109 and 125.

As seen in FIG. 1, the working fluid discharged through parallel connected fluid outlets 97, 113, 133 communicates by means of a common discharge conduit 137 with the parallel connected fluid outlets 99, 115, 131 through common discharge conduit 139. As shown in FIG. 1, additional fluid cylinder 63 is provided with detector means including switches 141 and 143. Switches 141 and 143 signal reversible flow type fluid driving pump 33 to reverse the flow of operating fluid through conduits 35, 19 when piston 76 reaches the end of its stroke at a predetermined position in cylinder 63.

The operation of the intensifier pump of the invention will now be described in greater detail. In the position shown in FIG. 1, reversible flow type pump 33 starts the flow of operating fluid through supply conduit 35 in the direction of the arrows. Operating fluid is supplied through conduit 35 to the side 37 of piston 15 in primary fluid cylinder 11, through fluid conduit 55 to side 57 of piston 45 and through fluid conduit 77 to side 79 of piston 67. The discharge conduit 139 will be under considerable back pressure. For example, in well fracturing, the working fluid is pumped into a well at a pressure great enough to crack the formation. Even in circulating well fluid down the well and back to the surface, considerable pressure is required because of the great depths.

Consequently, movement of the pistons 15, 45, and 67 in fluid cylinders 11, 43, and 63, respectively, is opposed by working fluid in fluid chambers 23, 53, 75 on shafts 19, 49, 71 and fluid pressure in conduit 139. Because of the greater relative diameter of primary piston 15, and the greater surface area acted upon by the operating fluid, primary piston 15 exerts a greater force than pistons 45 and 67 and creates a greater pressure in chamber 23 than in chambers 53 and 75. As piston 15 moves to the right, shaft 19 is stroked in chamber 23 thereby forcing working fluid past check valve 103 into conduit 139. This increases the pressure in conduit 139 to a level that is greater than the pressure in secondary chamber 53 and additional chamber 75. Pistons 45 and 67 remain stationary and check valves 119 and 135 remain closed while piston 15 moves.

As shaft 17 is being retracted in chamber 21, a vacuum is created in chamber 21, which draws working fluid from supply conduit 89 through fluid inlet 85 past check valve 93 into the chamber 21. Check valve 101 in fluid outlet 97 prevents the outflow of working fluid in the position shown. The remaining check valves in the system are in the closed position.

Figure 2:
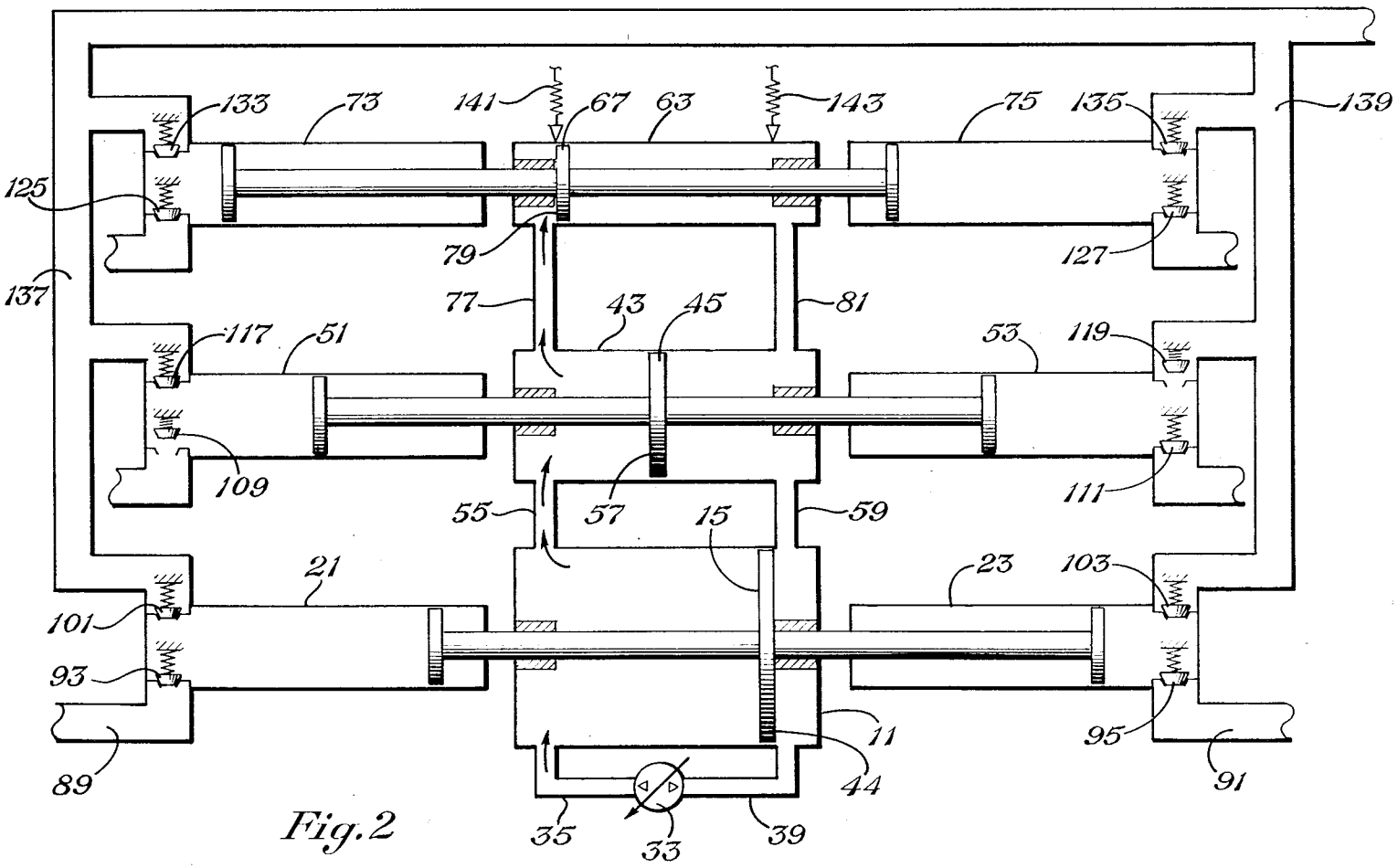
FIG. 2 is a schematic drawing similar to FIG. 1 showing the movement of the secondary piston in the secondary fluid cylinder.

Turning now to FIG. 2, the primary piston 15 is shown at the end of its stroke in the fully bottomed out right hand position of fluid cylinder 11. Once primary piston 15 is bottomed out in fluid cylinder 11, operating fluid pressure delivered by pump 33 increases on the high pressure side 57 of secondary piston 45 and the volume delivered decreases. When the pressure on side 57 causes the pressure in working chamber 53 to exceed the pressure in discharge conduit 139, piston 45 strokes to the right end of secondary fluid cylinder 43. As secondary piston 45 moves to the right, working fluid is admitted to fluid chamber 51 through check valve 109 and discharged from fluid chamber 53 through check valve 119. The remaining check valves in the system are in the closed position. The larger diameter of piston 45 than piston 67 causes a greater fluid pressure in chamber 53 and conduit 139 than in the chamber 75. This greater pressure keeps check valve 135 closed and piston 67 stationary.

Once secondary piston 45 bottoms out in the right hand position in fluid cylinder 43, operating fluid pressure from pump 33 further increases on the high pressure side 79 of additional piston 67 and the volume delivered decreases. Movement of additional piston 67 in fluid cylinder 63 begins when the pressure in working chamber 75 exceeds the pressure in discharge conduit 139. This causes working fluid to be admitted to chamber 73 through check valve 125 and discharged from chamber 75 through check valve 135.

When additional piston 67 nears the fully right hand position, switch 143 signals reversible driving pump 33 to reverse the direction of flow of operating fluid through conduits 35, 39. Working fluid is then supplied through conduit 39 to the side 41 of primary piston 15, allowing operating fluid to be drained through conduit 35. The pressure from pump 33 will be approximately the same as during the right hand stroke previously described. The pistons 15, 45, 67 are then stroked in identical fashion to that previously described but in the opposite sense, to complete one cycle of the intensifier pump. The primary piston 15 would move to the full left hand bottomed out position after which the secondary piston 45 would move to the left, followed by the additional piston 67. Once piston 67 nears the end of its stroke, switch 141 causes pump 33 to reverse the direction of flow of the operating fluid and the cycle is repeated.

The diameters of the pistons 15, 45, and 67 do not have to vary a great deal, with one embodiment having diameters of 9¼ inches, 9⅛ inches and 9 inches, respectively. The different diameters, the connection of the operating fluid cylinder inlets to the same source of operating fluid, and the connection of the working fluid outlets to the same discharge line, serve as staging means for causing the primary piston to reach the end of its stroke prior to the secondary piston.

Figure 3:
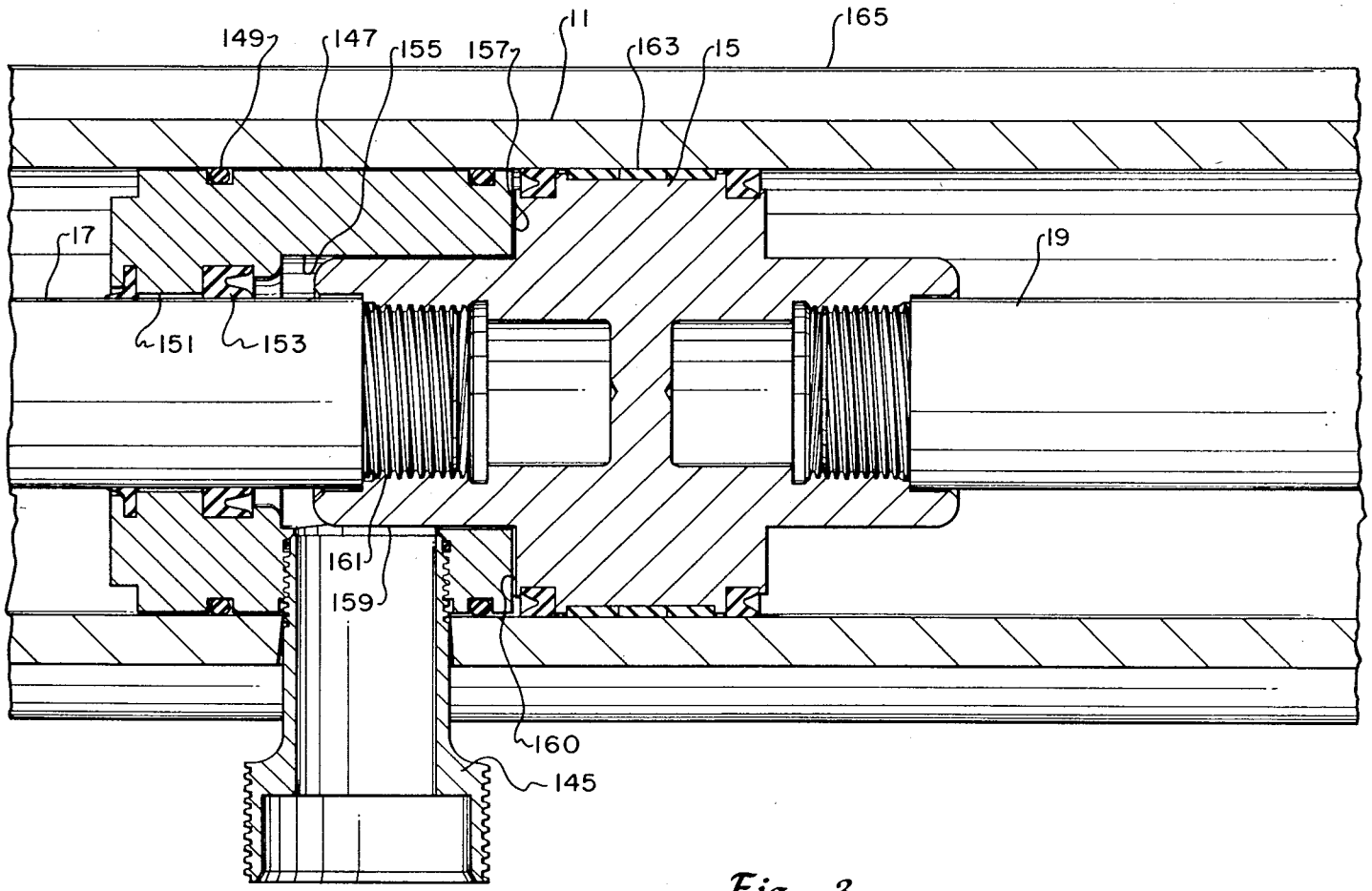
FIG. 3 is an enlarged more detailed drawing of portions of the primary piston and operating fluid cylinder of the intensifier pump of FIG. 1.

Referring to FIG. 3, portions of the larger primary operating fluid cylinder 11 are shown in more detail. The secondary operating fluid cylinder 43 has the same structure as the primary operating fluid cylinder 11, except for being smaller in diameter, thus is not shown. The smallest secondary operating fluid cylinder 63 (FIG. 1) is shown in more detail in FIG. 4. Referring still to FIG. 3, the primary piston 15 has shafts 17 and 19 extending outwardly from each side into the working fluid chambers 21 and 23 (FIG. 1). A port 145 is located at each end (only one shown) of the primary operating fluid cylinder 11 for the passage of hydraulic operating fluid from the pump 33 (FIG. 1). Hydraulic fluid flows in and out each port 145, depending upon the direction piston 15 is moving.

An end cap 147 is located at each end of (only one shown) the primary operating fluid cylinder 11. End cap 147 is sealed within the primary operating fluid cylinder 11 by seals 149. End cap 147 has a shaft bore 151 which contains seals 153 for sealing around the shaft 17. End cap 147 has a counterbore or nose bore portion 155 which is of larger diameter than the shaft bore 151, but smaller diameter than the piston 15. The nose bore 155 faces toward the piston 15, defining a shoulder 157 at its outer periphery.

The connection menas for connecting the shafts 17 and 19 to the primary piston 15 includes a nose portion 159 which is integrally formed on each side of primary piston 15 and smaller in diameter, defining a shoulder 160. Nose portion 159 is an outwardly protruding portion which has an outer diameter that is sized to be closely and slidingly received in the nose bore 155. There is a small clearance between nose portion 159 and nose bore 155 when nose portion 159 is inserted, and there are no seals located on the nose position 159 or in the nose bore 155. Consequently, hydraulic fluid can pass through the small clearance between the nose portion 159 and the nose bore 155. Internal threads 161 are located in the nose portion 159 for threadingly receiving the shafts 17 and 19. The piston 15 has seals 163 on its exterior for sealing in the primary operating fluid cylinder 11. Tie rods 165 are used to secure the operating fluid cylinder 11 to the working fluid chambers 21 and 23 (FIG. 1).

In the operation of the primary operating fluid cylinder 11, as the piston 15 nears the end of each stroke, when the nose portion 159 begins to enter the nose bore 155, a residual amount of fluid will be trapped in the annular space located between shoulders 157 and 160. The hydraulic operating fluid will not compress. The small clearance around the nose portion 159 and the nose bore 155, however, allows the residual amount of fluid to flow out through the port 145. Due to the small clearance, this flow is restricted greatly over the outward flow that occurs prior to the nose portion 159 entering the nose bore 155. The trapped fluid serves as fluid cushion means to cushion the end of the stroke of piston 15, preventing the shoulder 160 of piston 15 from striking the shoulder 157 with too much impact.

When the fluid is trapped, the pressure at the pump 33 (FIG. 1) will fairly quickly increase. Once the pressure increases about 150 psi, there will be enough pressure in the first secondary operating fluid cylinder 43 (FIG. 1) to cause the piston 45 to begin to stroke. The primary piston 15 will bottom out and remain stationary while the first secondary piston 45 begins to stroke to the left. Also, the second secondary piston 67 (FIG. 1) remain stationary and will not begin its stroke until both the first piston 15 and the second piston 45 complete their strokes. As shown in FIG. 3, at the completion of the stroke, when all of the residual fluid has been dissipated and shoulders 157 and 159 are in contact with each other, the forward portion of the nose portion 159 will be spaced from the end of the nose bore 155. The nose bore 155 has a greater length than the nose portion 159.

Figure 4:
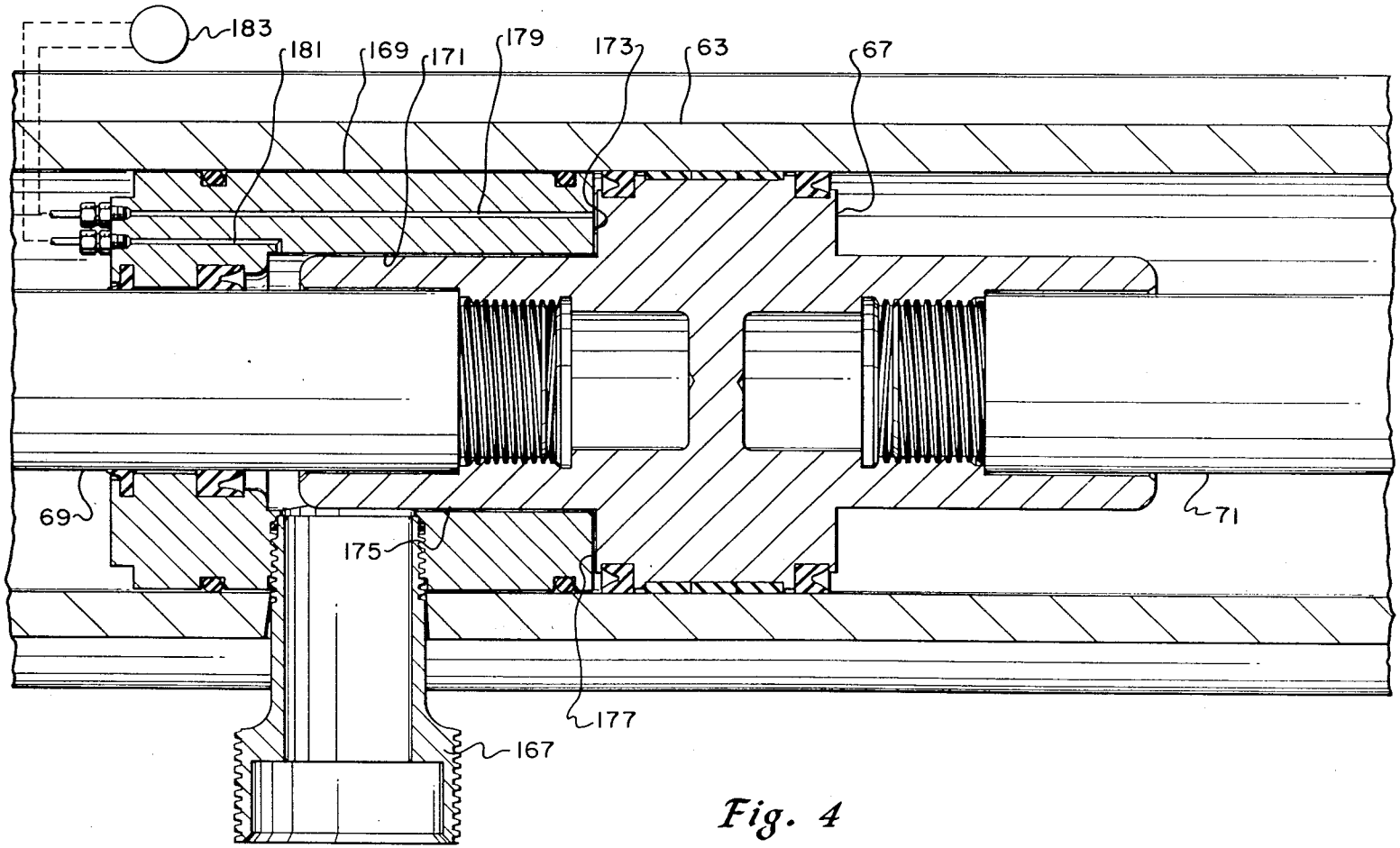
FIG. 4 is an enlarged more detailed drawing of portions of the smallest secondary piston and operating fluid cylinder of the intensifier pump of FIG. 1.

Referring now to FIG. 4, the smallest secondary operating fluid cylinder 63 is shown. Secondary piston 67 is connected to shafts 69 and 71. A port 167 on each end communicates hydraulic fluid with the pump 33 (FIG. 1). An end cap 169 is located inside the operating fluid cylinder 63 at each end, to which the port 167 is secured. End cap 169 has a nose bore 171, which defines a shoulder 173. Secondary piston 67 has a nose portion 175 that is smaller in diameter than the piston 67 for close reception in the nose bore 171. This defines a shoulder 177 at the junction of the nose portion 175 and the piston 67. Shafts 69 and 71 are secured to the nose portion 175 in the same manner as with piston 15, shown in FIG. 3. Seals, not specifically enumerated, are located in the same manner as in the primary operating fluid cylinder 11, as shown in FIG. 3.

The structure in the smallest operating fluid cylinder 63 differs in that the nose portion 175 is considerably longer than the nose portion 159 on the primary piston 15 or on the first secondary piston 45 (FIG. 1) which is the same length as primary piston 15. Similarly, the nose bore 171 is made longer so as to accommodate the entire length of the nose portion 175 without the outer end of the nose portion 175 contacting the interior of the end cap 169. The greater length is needed to provide increased dampening for the piston 67 as it nears the end of its stroke. When the second piston 45 reaches the end of its stroke, about a 150 psi increase in pressure will cause the third piston 67 to begin its stroke. However, at the end of the stroke of the third piston 67, the pump 33 (FIG. 1) must reverse to supply fluid to the opposite side of the primary piston 15 to cause it to stroke in the opposite direction. This takes time, and to avoid high pressure spikes, pump 33 reverses before the piston 67 bottoms out, which occurs when the shoulder 177 contacts the shoulder 173. The additional length of the nose portion 175 provides an additional amount of trapped fluid between shoulders 173 and 175, to increase the dampening time. This results in a longer amount of time after the piston 67 first encounters the increased resistance due to the trapped residual fluid before the residual fluid is completely dissipated through the port 167 and the shoulders 173 and 177 come into contact. In the preferred embodiment for pistons 15, 45 and 67 having diameters respectively of $9\frac{1}{4}$ inch, $9\frac{1}{8}$ inch, and 9 inch, the nose portion 159 for the pistons 45 and 15 is four inches, while the nose portion 175 for the piston 67 is seven inches. Consequently, the nose portions 159 are only 57% the length of the nose portion 175. The stroke for pistons 15 and 45 is preferably about 30 inches.

Referring still to FIG. 4, the detection means for detecting when piston 67 has reached the end of its stroke, and for causing the pump 33 (FIG. 1) to reverse, includes a passage 179 leading from shoulder 173. There is also a passage 181 which leads from the nose bore 171, but at the inward end, where it is always in communication with the port 167. Passages 179 and 181 lead to a pressure switch 183. Switch 183 monitors the difference in pressure between the hydraulic fluid at the two points. Prior to nose portion 175 entering the nose bore 171, the pressure at shoulder 173 would be the same as at port 167. Once the nose portion 175 enters the nose bore 171, residual fluid would be trapped between the shoulders 173 and 177, causing a pressure increase. The difference in pressure between the fluid in the residual trapped area and at the discharge port 167 is sensed by the pressure switch 183, which controls the operation of the pump 33 (FIG. 1). In the preferred embodiment, when the pressure differential reaches 1200 psi, the pump 33 is signaled to reverse.

When the hydraulic pump 33 reverses, piston 15 begins to move in the opposite direction while piston 67 and piston 45 (FIG. 1) will remain stationary. Piston 67 will remain stationary until piston 45 completes the stroke in the opposite direction. There is a pressure switch 183 on the opposite end (not shown) of the smallest secondary fluid cylinder 63 which is identical to the one shown in FIG. 4. When piston 67 reaches the opposite end as shown in FIG. 4, the cycle will repeat.

An invention has been provided with significant advantages. The present intensifier pump is simple in design and reliable in operation. The unique operating fluid cylinder system allows the pistons to be cycled without air logic or complicated electronic control systems. The novel control system of the intensifier pump of the invention uses selectively sized operating pistons and a closed loop operating fluid system to cycle the pump. The present intensifier pump can be produced with standard type fluid cylinder ends on the discharge or well working fluid side for ease and simplicity of manufacture. The diameters of the operating fluid pistons and piston shaft ends can be selectively sized and ratioed to cover any needed pressure multiplication ratio or discharge rate required from the pump.

While the invention has been shown in only one of its forms, it is not thus limited but is susceptible to various changes and modifications without departing from the scope thereof.

I claim:

1. A pump for pumping a liquid working fluid comprising in combination:

primary and secondary operating fluid cylinders, having ports in each end and containing primary and secondary pistons, respectively;

reversible pump means for alternately supplying operating fluid simultaneously to the ports of the operating fluid cylinders on one side of the pistons while draining from the ports on the opposite side of the pistons to cause the pistons to stroke in two directions;

the primary and secondary pistons having shaft portions extending outward and received within primary and secondary working fluid chambers, respectively;

the working fluid chambers having inlets leading to a common source of working fluid, and outlets connected in parallel to a common discharge conduit;

the diameters of the pistons and their shaft portions being selected such that for a given operating fluid pressure initially applied to both of the pistons, a greater output pressure will be initially created in the primary working fluid chamber than in the secondary working fluid chamber, which is applied to the outlet of the secondary working fluid chamber, delaying movement of the secondary piston during each stroke, until the primary piston reaches the end of its stroke, the reversible pump means then increasing the operating fluid pressure sufficient in the secondary operating fluid cylinder to cause the secondary piston to stroke while the primary piston remains stationary; and fluid cushion means at the end of each operating fluid cylinder, for trapping a residual amount of operating fluid between each piston and the nearest port as the piston nears the end of its stroke, and for retarding the flow of the residual amount out the nearest port to dampen the movement of the piston as it nears the end of its stroke; the fluid cushion means of the degree of dampening than the fluid cushion means of the primary operating fluid chamber, to provide time for the reversible pump means to reverse flow before the secondary piston reaches the limit of its travel.

2. The pump according to claim 1 wherein the fluid cushion means of the secondary operating fluid chamber traps a greater residual amount of operating fluid than the fluid cushion means of the primary operating fluid chamber.

3. A pump for pumping a liquid working fluid, comprising in combination:

primary and secondary operating fluid cylinders, having ports on each end and containing primary and secondary pistons, respectively, with the primary piston being larger in diameter than the secondary piston;

reversible pump means for alternately supplying operating fluid simultaneously to the ports of the operating fluid cylinders on one side of the pistons while draining from the ports on the opposite side of the pistons to cause the pistons to stroke in two directions;

the primary and secondary pistons having shaft portions extending outward and received within primary and secondary working fluid chambers, respectively;

the working fluid chambers having inlets leading to a common source of working fluid, and outlets connected in parallel to a common discharge conduit;

the larger diameter of the primary piston initially creating a higher pressure in the discharge conduit than initially in the secondary working fluid chamber, delaying movement of the secondary piston until the primary piston reaches the end of its stroke; and fluid cushion means at the end of each operating fluid cylinder, for trapping a residual amount of operating fluid between each piston and the nearest port as the piston nears the end of its stroke, and for retarding the flow of the residual amount out the nearest port to dampen the movement of the piston as it nears the end of its stroke; the fluid cushion means of the secondary operating fluid chamber providing a greater degree of dampening than the fluid cushion means of the primary operating fluid chamber, to provide time for the reversible pump means to reverse flow before the secondary piston reaches the limit of its travel.

4. A pump for pumping a liquid working fluid comprising in combination:

primary and secondary operating fluid cylinders, having ports in each end and containing primary and secondary pistons, respectively;

reversible pump means for alternately supplying operating fluid simultaneously to the ports of the operating fluid cylinders on one side of the pistons while draining from the ports on the opposite side of the pistons to cause the pistons to stroke in two directions;

a shaft extending outward from each piston and received within primary and secondary working fluid chambers, respectively;

connection means for connecting each of the shafts to each of the pistons, the connection means including a nose portion protruding from each side of the piston which is larger in diameter than the shaft, but smaller in diameter than the piston;

each operating fluid cylinder having adjacent each port a shaft bore through which the shaft sealingly reciprocates, and a nose bore of larger diameter than the shaft bore, but smaller in diameter than the piston, for receiving the nose portion at the end of each stroke, the nose bore defining a shoulder facing the piston to trap a residual amount of operating fluid between the piston and shoulder as the nose portion enters the nose bore, causing the trapped operating fluid to flow out to the port between the nose portion and nose bore to dampen movement of the piston as it nears the end of its stroke;

the diameters of the pistons and the shafts being selected such that for a given operating fluid pressure initially applied to both of the pistons, a greater output pressure will be initially created in the primary working fluid chamber than in the secondary working fluid chamber, which is applied to the outlet port of the secondary working fluid chamber to delay movement of the secondary piston during each stroke until the primary piston reaches the end of its stroke, the reversible pump means then increasing the operating fluid pressure sufficiently in the secondary operating fluid cylinder to cause the secondary piston to stroke while the primary piston remains stationary;

the nose portion of the connection means for the secondary piston being larger than the nose portion of the connection means for the primary piston, to provide greater dampening for the secondary piston than the primary piston, to reduce the chance for impact of the secondary piston against the shoulder prior to the reversible pump means reversing.

5. The pump according to claim 4 further comprising:

pressure sensing means connected to the secondary operating fluid cylinder for sensing the pressure of the residual amount of operating fluid as the nose portion of the connection means for the secondary piston enters the nose bore, and for causing the reversible pump means to reverse its flow direction when the pressure of the residual amount of operating fluid exceeds the discharge pressure out the port by a selected amount.

6. A pump for pumping a liquid working fluid comprising in combination:

primary and secondary operating fluid cylinders, having ports on each end and containing primary and secondary pistons, respectively, with the primary piston being larger in diameter than the secondary piston;

reversible pump means for alternately supplying operating fluid simultaneously to the ports of the operating fluid cylinders on one side of the pistons while draining from the ports on the opposite side of the pistons to cause the pistons to stroke in two directions;

a shaft extending outward from each piston and received within primary and secondary working fluid chambers, respectively;

connection means for connecting each of the shafts to each of the pistons, the connection means including a nose portion protruding from each side of the piston which is larger in diameter than the shaft, but smaller in diameter than the piston;

each operating fluid cylinder having adjacent each port a shaft bore through which the shaft sealingly reciprocates, and a nose bore larger diameter than the shaft bore, but smaller in diameter than the piston, for receiving the nose portion at the end of each stroke, the nose bore defining a shoulder facing the piston to trap a residual amount of operating fluid between the piston and shoulder as the nose portion enters the nose bore, causing the trapped operating fluid to flow out to the port between the nose portion and nose bore to dampen movement of the piston as it nears the end of its stroke;

the nose portion of the connection means for the secondary piston being longer than the nose portion of the connection means for the primary piston, to provide greater dampening for the secondary piston than the primary piston, to reduce the chance for impact of the secondary piston against the shoulder prior to the reversible pump means reversing; and pressure sensing means connected to the secondary operating fluid cylinder for sensing the discharge pressure out the port and also for sensing the pressure of the residual amount of operating fluid as the nose portion of the connection means of the secondary piston enters the nose bore, and for causing the reversible pump means to reverse its flow direction when the pressure of the residual amount of operating fluid exceeds the discharge pressure by a selected amount.

* * * * *